US006718936B2

(12) United States Patent
Matsuda

(10) Patent No.: US 6,718,936 B2
(45) Date of Patent: Apr. 13, 2004

(54) FOUR-CYCLE ENGINE FOR SMALL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/154,610

(22) Filed: May 22, 2002

(65) Prior Publication Data

US 2002/0179045 A1 Dec. 5, 2002

(30) Foreign Application Priority Data

Jun. 1, 2001 (JP) ..... 2001-166120

(51) Int. Cl.[7] ..... F01M 9/10
(52) U.S. Cl. ..... 123/196 R
(58) Field of Search ..... 123/196 R, 311, 123/196 W, 73 AD

(56) References Cited

U.S. PATENT DOCUMENTS 5,941,745 A * 8/1999 Kanno ..... 440/88 R
6,516,756 B1 * 2/2003 Kato et al. ..... 123/73 AD
6,540,573 B2 * 4/2003 Sato ..... 440/88 R

FOREIGN PATENT DOCUMENTS

JP 7-317520 12/1995

* cited by examiner

*Primary Examiner*—Tony M. Argenbright
*Assistant Examiner*—Katrina B. Harris
(74) *Attorney, Agent, or Firm*—Kolisch Hartwell, P.C.

(57) ABSTRACT

Disclosed is a four-cycle engine for a small watercraft including a fuel injector for injecting a fuel into an air-intake passage through an injection nozzle, an openable valve provided in the air-intake passage for regulating an intake amount of air into a cylinder, a fuel supply passage through which the fuel is supplied to the fuel injector, and an oil supply passage connected to the fuel supply passage through forced oil supply means, wherein a proper amount of oil can be sufficiently supplied to the fuel supply passage by the forced oil supply means during engine running, irrespective of a position of the valve in the air-intake passage, that is, the position of an oil supply port in the air-intake passage.

9 Claims, 9 Drawing Sheets

FOUR-CYCLE ENGINE FOR SMALL WATERCRAFT

BACKGROUND OF THE INVENTION

1. Field of the Invention

The present invention relates to a four-cycle engine for a small watercraft such as a personal watercraft (PWC) which ejects water rearward and planes on a water surface as the resulting reaction.

2. Description of the Related Art

In recent years, small watercraft such as jet-propulsion personal watercraft have been widely used in leisure, sport, rescue activities, and the like. The jet-propulsion watercraft is configured to have a water jet pump that pressurizes and accelerates water sucked from a water intake generally provided on a bottom of a hull and ejects it rearward from an outlet port. Thereby, the jet-propulsion watercraft is propelled.

In the jet-propulsion watercraft, a steering nozzle provided behind the outlet port of the water jet pump is swung either to the right or to the left, to change the ejection direction of the water to the right or to the left, thereby turning the watercraft to the right or to the left.

In the case of the jet-propulsion personal watercraft, which is one type of the small watercraft, recently, a four-cycle internal combustion engine (four-cycle engine) has been employed in place of a two-cycle internal combustion engine (two-cycle engine), as in the case of other small watercrafts.

In consideration of improvement in response and fuel consumption of the engine, in some cases, a fuel injection type engine which injects a fuel into an air-intake passage has been employed in recent small watercrafts.

In the case of the two-cycle engine of the fuel injection type engine, oil is mixed into a fuel itself. Therefore, oil is supplied to a valve such as a throttle valve provided in the air-intake passage and a valve stem thereof.

Meanwhile, in the case of the four-cycle engine, the oil is not contained in the fuel to be supplied.

Accordingly, when the four-cycle engine is employed, it is necessary to provide an oil supply port and an oil supplier having an electromagnetic valve in the vicinity of the valve in the air-intake passage for the purpose of supplying an oil, as disclosed in Japanese Laid-Open Patent Publication No. Hei 7-317520.

Actually, however, the oil itself is difficult to spread because of its high viscosity. Therefore, when the valve is provided in the vicinity of the oil supply port, the oil is sufficiently supplied, while when the valve is provided apart from the oil support port, the oil is not sufficiently supplied. Also, some engines are provided with a plurality of valves in the air-intake passage. In that case, the oil is sufficiently supplied to the valve positioned in the vicinity of the oil supply port, while the oil is not sufficiently supplied to the valve positioned apart therefrom.

SUMMARY OF THE INVENTION

The present invention addresses the above-described condition, and an object of the present invention is to provide a four-cycle engine for a small watercraft, capable of sufficiently supplying oil to a valve irrespective of the position of the valve in an air-intake passage, that is, the position of an oil supply port in the air-intake passage.

According to the present invention, there is provided a four-cycle engine for a small watercraft comprising: a fuel injector for injecting a fuel into an air-intake passage through an injection nozzle; an openable valve provided in the air-intake passage for regulating an intake amount of air into a cylinder; a fuel supply passage through which the fuel is supplied to the injector; and an oil supply passage connected to the fuel supply passage through forced oil supply means, wherein a proper amount of oil is supplied to the fuel supply passage by the forced oil supply means during engine running.

In the four-cycle engine for the small watercraft so constituted, the oil is mixed into the fuel and the resulting oil-fuel mixture is supplied from the fuel injection nozzle into the air-intake passage. Since the viscosity of the oil-fuel mixture is low as a whole, the oil is supplied to the valve regardless of whether the valve is positioned apart from or in the vicinity of the fuel injection nozzle. In addition, because of the low viscosity, the oil is also lubricated sufficiently to a narrow space around a valve stem. As a matter of course, since the oil is always supplied to the surface of the valve, the rustproof effect can be produced on the surface of the valve.

In the four-cycle engine for the small watercraft, it is preferable that the forced oil supply means includes an electromagnetic valve, and the electromagnetic valve is operated according to an engine speed, thereby changing an amount of oil supply according to the engine speed. With this constitution, when the engine speed is high and, therefore the amount of oil supply needs to be increased, a large amount of oil is supplied, while when the engine speed is low and, therefore, the amount of oil supply needs to be reduced, a small amount of oil is supplied.

In the four-cycle engine for the small watercraft, it is preferable that an open time of the electromagnetic valve is increased according to an increase in the engine speed. Otherwise, it is preferable that an opening of the electromagnetic valve is increased according to an increase in the engine speed.

In the four-cycle engine for the small watercraft, it is preferable that the oil is supplied in an oil-to-fuel volume ratio in a range of approximately 3:1000 to approximately 20:1000. Thereby, desired functions and effects can be obtained.

According to the present invention, even when the fuel injection type four-cycle engine is employed as the engine for the small watercraft, the oil is supplied to the valve irrespective of the position of the valve in the air-intake passage; that is, the position of the oil supply port in the air-intake passage.

As a result, since the oil is supplied to the valve in the air-intake passage and a portion provided around its stem, the rustproof effect and the lubricating function can be fulfilled. This facilitates the generalization of the fuel injection type four-cycle engine as the engine for the small watercraft.

The above and further objects and features of the invention will more fully be apparent from the following detailed description with accompanying drawings.

DETAILED DESCRIPTION OF THE PREFERRED EMBODIMENTS

Hereinafter, a four-cycle engine for a small watercraft according to an embodiment of the present invention will be described with reference to accompanying drawings. In the embodiment below, a personal watercraft in which the four-cycle engine is mounted will be described.

Figure 8:
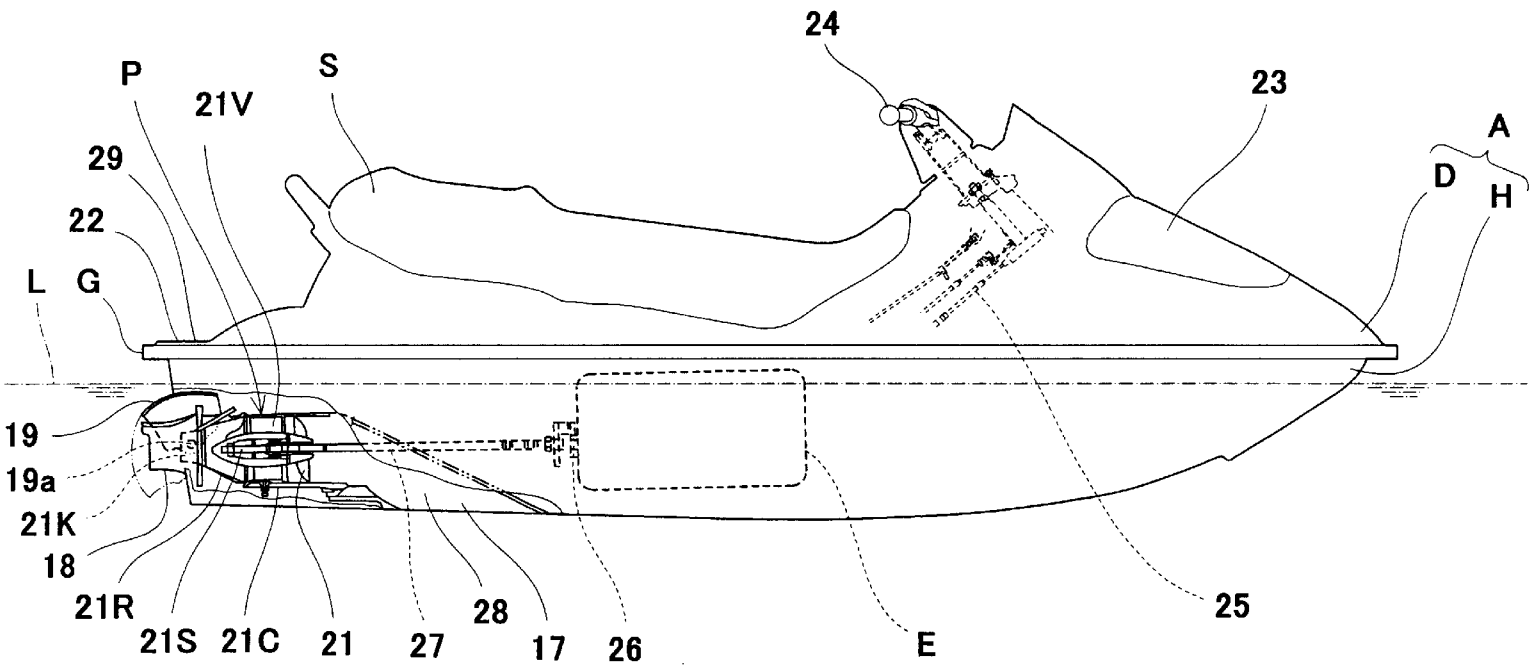
FIG. 8 is a side view showing the entire jet-propulsion personal watercraft according to the embodiment of the present invention.
Figure 9:
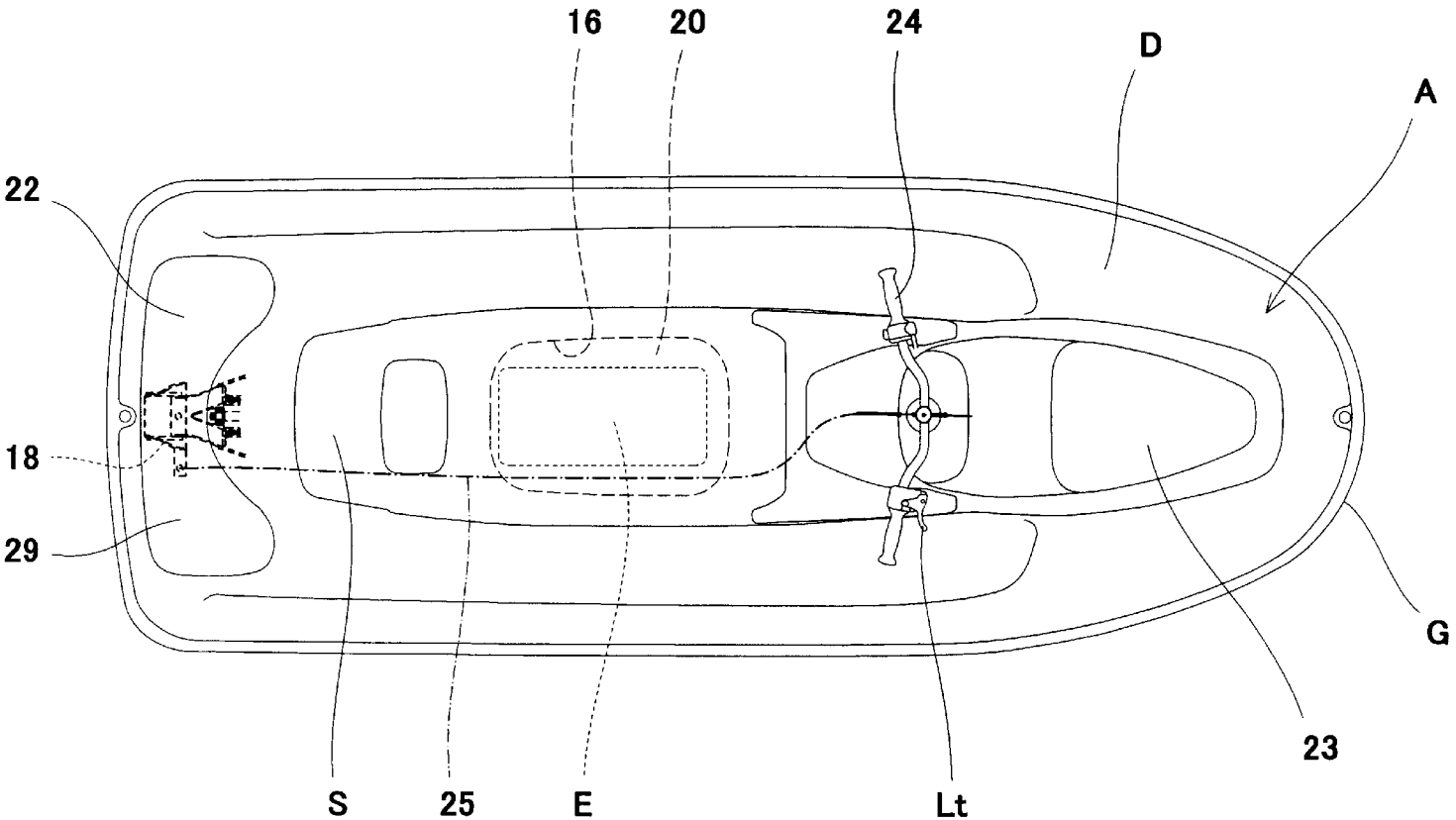
FIG. 9 is a plan view showing the entire personal watercraft of FIG. 8

Referring now to FIGS. 8, 9, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 9, an opening 16, which has a substantially rectangular shape seen from above, is formed at a relatively rear section of the deck D such that it extends in the longitudinal direction of the body A, and a riding seat S is provided above the opening 16 such that it covers the opening 16 from above as shown in FIGS. 8, 9.

An engine E is provided in a chamber 20 surrounded by the hull H and the deck D below the seat S.

The engine E includes multiple cylinders (e.g., four-cylinders). As shown in FIG. 8, a crankshaft 26 of the engine E is mounted along the longitudinal direction of the body A. An output end of the crankshaft 26 is rotatably coupled integrally with a pump shaft of a water jet pump P through a propeller shaft 27. An impeller 21 is mounted on the pump shaft of the water jet pump P. The impeller 21 is covered with a pump casing 21C on the outer periphery thereof. A water intake 17 is provided on the bottom of the hull H. The water is sucked from the water intake 17 and fed to the water jet pump P through a water intake passage 28. The water jet pump P pressurizes and accelerates the water. The pressurized and accelerated water is discharged through a pump nozzle 21R having a cross-sectional area of flow gradually reduced rearward, and from an outlet port 21K provided on the rear end of the pump nozzle 21R, thereby obtaining a propulsion force.

In FIG. 8, reference numeral 21V denotes fairing vanes for fairing water flow behind the impeller 21. As shown in FIGS. 8, 9, reference numeral 24 denotes a bar-type steering handle as a steering operation means. The handle 24 is operated via a wire cable 25 to the right or to the left in association with the steering nozzle 18 provided behind the pump nozzle 21R such that the steering nozzle 18 is swingable to the right or to the left. The watercraft can be turned to any desired direction while the water jet pump P is generating a propulsion force. A throttle lever Lt is mounted on the right end portion of the handle 24.

As shown in FIG. 8, a bowl-shaped reverse deflector 19 (see FIG. 8) is provided above the rear side of the steering nozzle 18 such that it can swing downward around a horizontally mounted swinging shaft 19*a*.

The deflector 19 is swung downward toward a lower position behind the steering nozzle 18 to deflect the water ejected from the steering nozzle 18 forward, and as the resulting reaction, the personal watercraft moves rearward.

In FIGS. 8, 9, reference numeral 22 denotes a rear deck. The rear deck 22 is provided with an openable hatch cover 29. A rear compartment (not shown) with a small capacity is provided under the hatch cover 29. Reference numeral 23 denotes a front hatch cover. A front compartment (not shown) is provided under the front batch cover 23 for storing equipment and the like.

Figure 1:
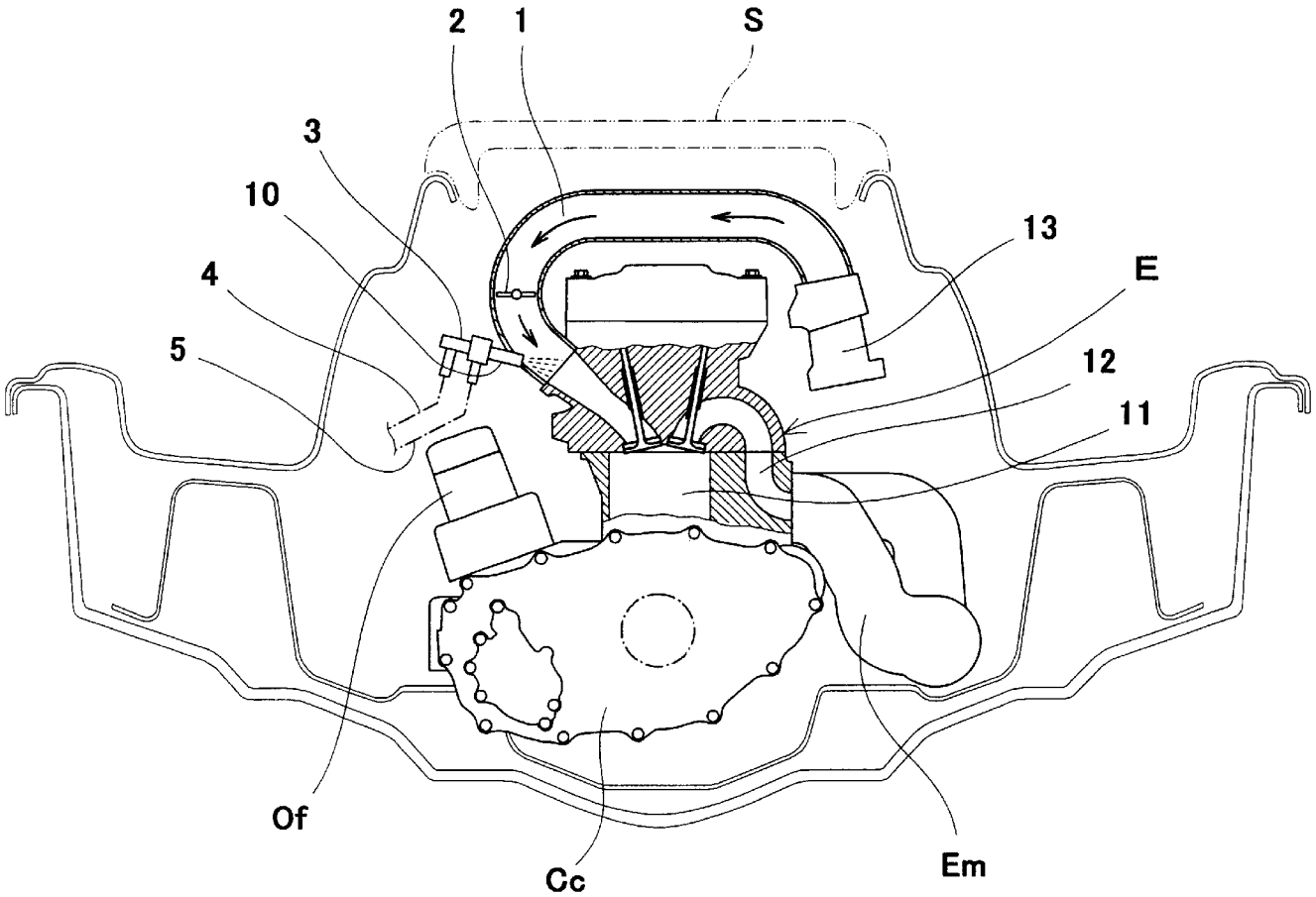
FIG. 1 is a partially cross-sectional front view showing a four-cycle engine mounted in a personal watercraft according to an embodiment of the present invention and sectioned along a direction orthogonal to a crankshaft.
Figure 2:
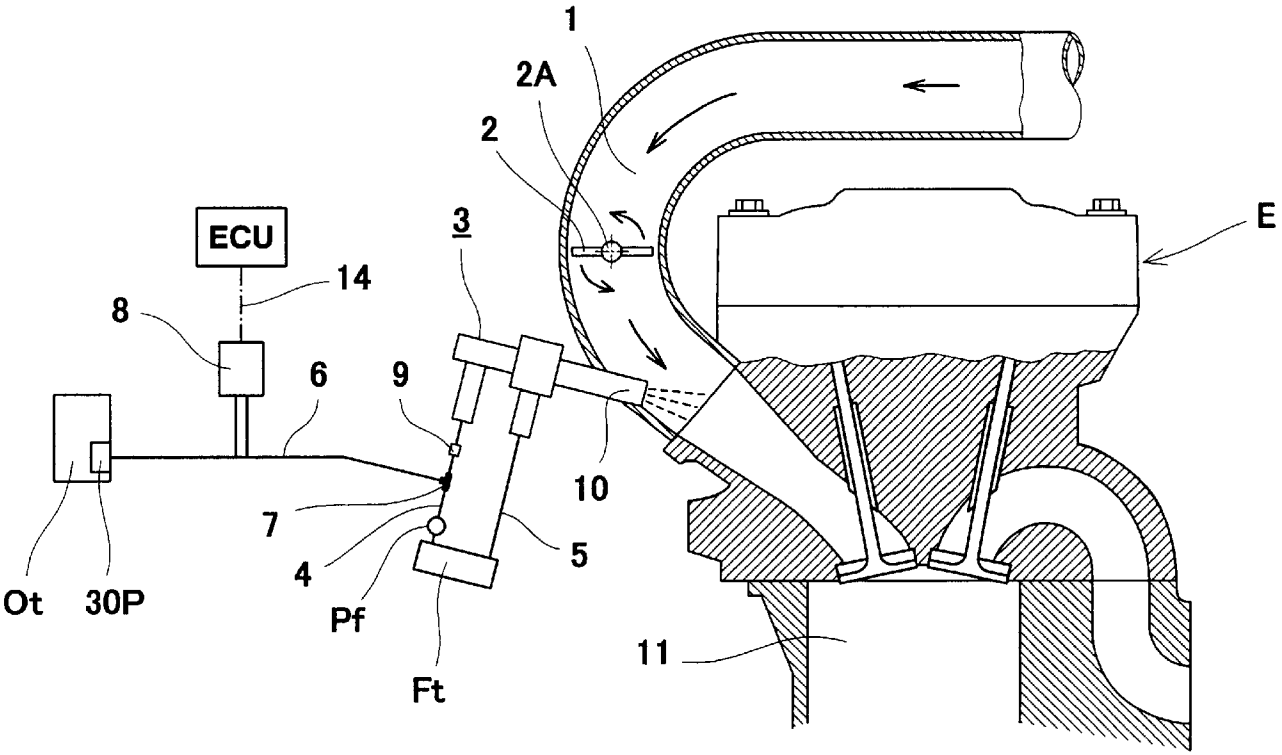
FIG. 2 is a partially enlarged cross-sectional view showing an air-intake passage, a cylinder head portion, and a fuel injector of FIG. 1, and a fuel supply system schematically shown, which is connected to the fuel injector.

A multi-cylinder engine E of the four-cycle has an air-intake passage 1 for supplying air into a combustion chamber as shown in FIGS. 1 and 2. A throttle valve 2 for regulating the amount of air is rotatably provided in the air-intake passage 1 around a stem 2A (see FIG. 2). The throttle valve 2 is constituted to be operated in association with operation of a throttle lever Lt (see FIG. 9) by an operator. In the embodiment, a fuel injector 3 with an injection nozzle 10 having a tip end opened to the air-intake passage 1 is provided on the rear flow side of the throttle valve 2.

As shown in FIG. 2, a fuel supply passage 4 having a base end communicating with a fuel tank Ft, a pressure regulator 9 provided in the fuel supply passage 4, and a fuel returning passage 5 for returning an excessive fuel from the fuel injector 3 to the fuel tank Ft side are connected to the fuel injector 3, and a circulating path is formed between the fuel tank Ft and the fuel injector 3 to allow circulation of the fuel. The fuel pump Pf is provided in the fuel supply passage 4.

As shown in FIG. 2, an oil supply passage 6 is connected to the fuel supply passage 4 through a T-shaped tube 7 and the base end of the oil supply passage 6 is connected to an oil tank Ot comprising an oil pump 30P. The oil supply passage 6 is provided with forced oil supply means having an electromagnetic valve 8. By controlling a current sent to the electromagnetic valve 8, the oil is supplied from the oil tank Ot into the fuel supply passage 4 through the oil supply passage 6 depending on the oil amount under control of an electric control unit (ECU).

The electromagnetic valve 8 is connected to the ECU through a signal line 14 and the open position (open degree) or open time of the electromagnetic valve 8 is regulated depending on (in proportion to) an engine speed, the load state of the engine and the like. When the engine speed is high and the load is great, that is, the amount of fuel supply is large, a large amount of oil is supplied. On the other hand, when the engine speed is low and the load is small, that is, the amount of fuel supply is small, a small amount of oil is supplied.

The electric control unit (ECU) performs control to optimize the ignition time of the engine E, the injection time of the fuel, the amount of fuel injection and the like according to the situations such as the operational state of the throttle lever Lt by the operator, the load state of the engine, and the engine speed. In FIG. 1, reference numeral 13 denotes an air box for supplying clean air to the air-intake passage 1 of the engine E, "Of" denotes an oil filter, reference numeral 12 denotes an exhaust passage, "Em" denotes an exhaust manifold, and "Cc" denotes a crank case.

According to the four-cycle engine constituted as described above, when the engine is running, the air is supplied through the air-intake passage 1 and the fuel (gasoline) containing the oil is injected into the air-intake passage 1 through the fuel injector 3. The resulting air-fuel mixture is supplied into a cylinder 11 of the engine.

The oil is mixed into the fuel according to the amount of the fuel to be supplied. That is, the oil is mixed into the fuel at a nearly fixed ratio.

For this reason, when the fuel containing the oil is injected from the injection nozzle 10, the air-intake passage 1 is filled with the vaporized fuel containing the oil, and the vaporized fuel also reaches the throttle valve 2 side upstream of the fuel injector 3. The oil mixed in the fuel produces the rustproof effect on the surface of the throttle valve 2. The oil mixed in the fuel also allows the movable portion of the stem 2A of the throttle valve 2 to smoothly rotate. Similarly to the throttle valve 2, in the case in which a choke valve is provided in the air-intake passage, the oil mixed in the fuel is also supplied to the choke valve and its valve stem. Further, the oil in the fuel is supplied to an air-intake valve and its valve stem which are positioned in the end portion of the air-intake passage. Thereby, the rustproof effect for these members and their smooth operation can be achieved.

Accordingly, the present invention is preferable to a personal watercraft which is used on the sea and sucks air containing salinity.

Through experiments carried out by the present inventor, it has been found that the rustproof effect and the lubrication effect of the movable portion can be obtained when the oil-fuel mixture has an oil-to-fuel volume ratio of approximately 3:1000 to approximately 20:1000. Also, it has been found that a satisfactory combustion condition can be maintained even if the oil with this small ratio is mixed into the fuel. To meet requirements of the rustproof effect and the satisfactory combustion condition, it is particularly preferable that the oil-to-fuel volume ratio is approximately 8:1000 to approximately 12:1000.

While the description has been given to the example in which one throttle valve 2 is provided in the air-intake passage 1 in the embodiment, some engines are provided with two-throttle valves. Also in that case, the same functions and effects as described above can be obtained. This is because the oil-fuel mixture containing the oil with the above identified small ratio has the low viscosity as a whole, regardless of the fact that the oil itself is highly viscous. Consequently, the rustproof effect and smooth rotation can be fulfilled in both the throttle valve positioned apart from the fuel injector and the throttle valve positioned in the vicinity thereof.

As an alternative to the above mentioned embodiment, there may be used an electromagnetic valve adapted to operate for a fixed time and at a fixed open position, and the frequency of the "open" operation of the electromagnetic valve may be changed according to the engine speed.

Furthermore, the mixing (supply) of the oil into the fuel is not carried out all the time but in a proper timing; for example, once every three minutes or once every 5000 rotations.

Figure 3:
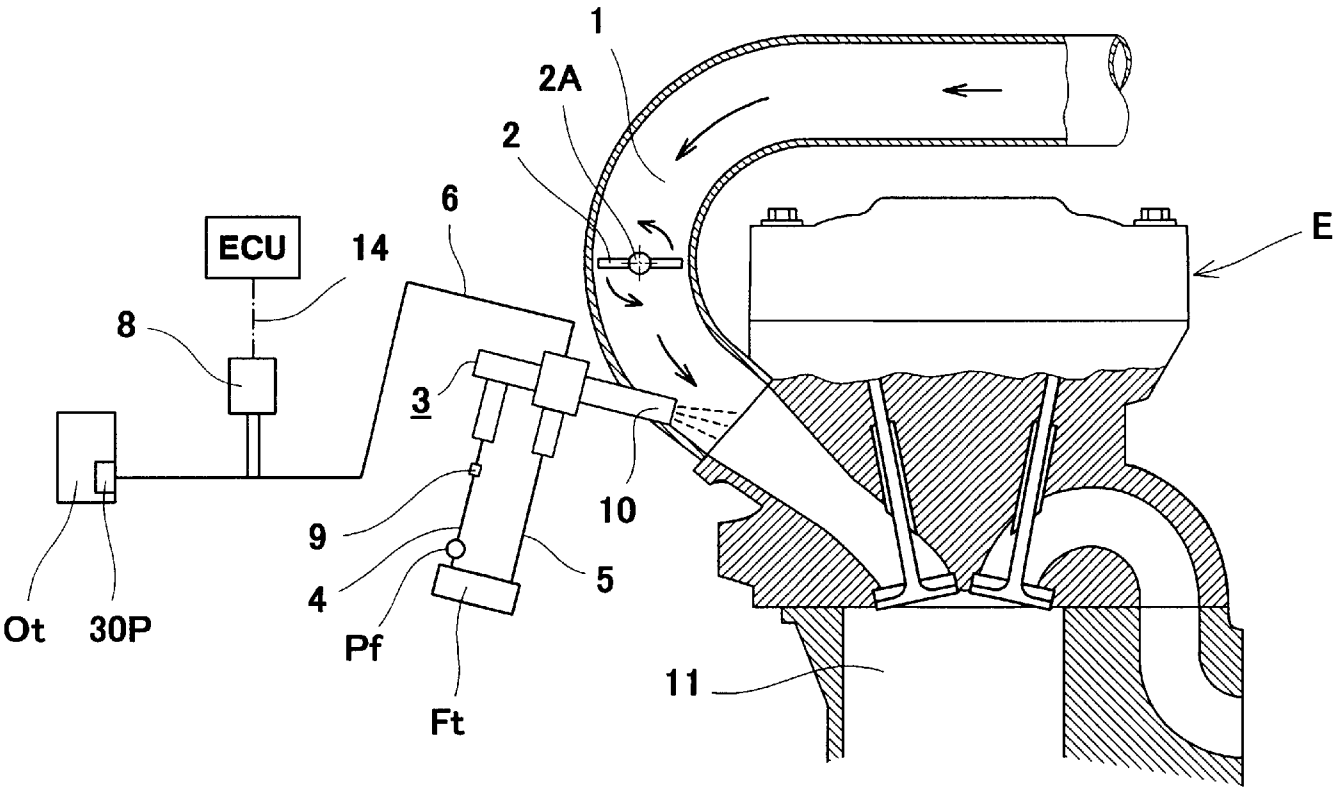
FIG. 3 is a partially enlarged cross-sectional view showing an oil supply system and a fuel supply system according to an embodiment different from that of FIG. 2.

In the embodiment, the tip of the oil supply passage 6 is connected to the fuel supply passage 4. Instead, the oil supply passage 6 may be provided independently of the fuel circulating path as shown in FIG. 3 by directly connecting the tip end of the oil supply passage 6 to the fuel injector 3. Also in that case, the basic function and effects of the present invention can be obtained. Besides, the oil does not go into the fuel tank Ft and the oil consumption can be reduced. In FIG. 3, the same reference numerals as those in FIG. 2 denote the same or corresponding parts.

Figure 4:
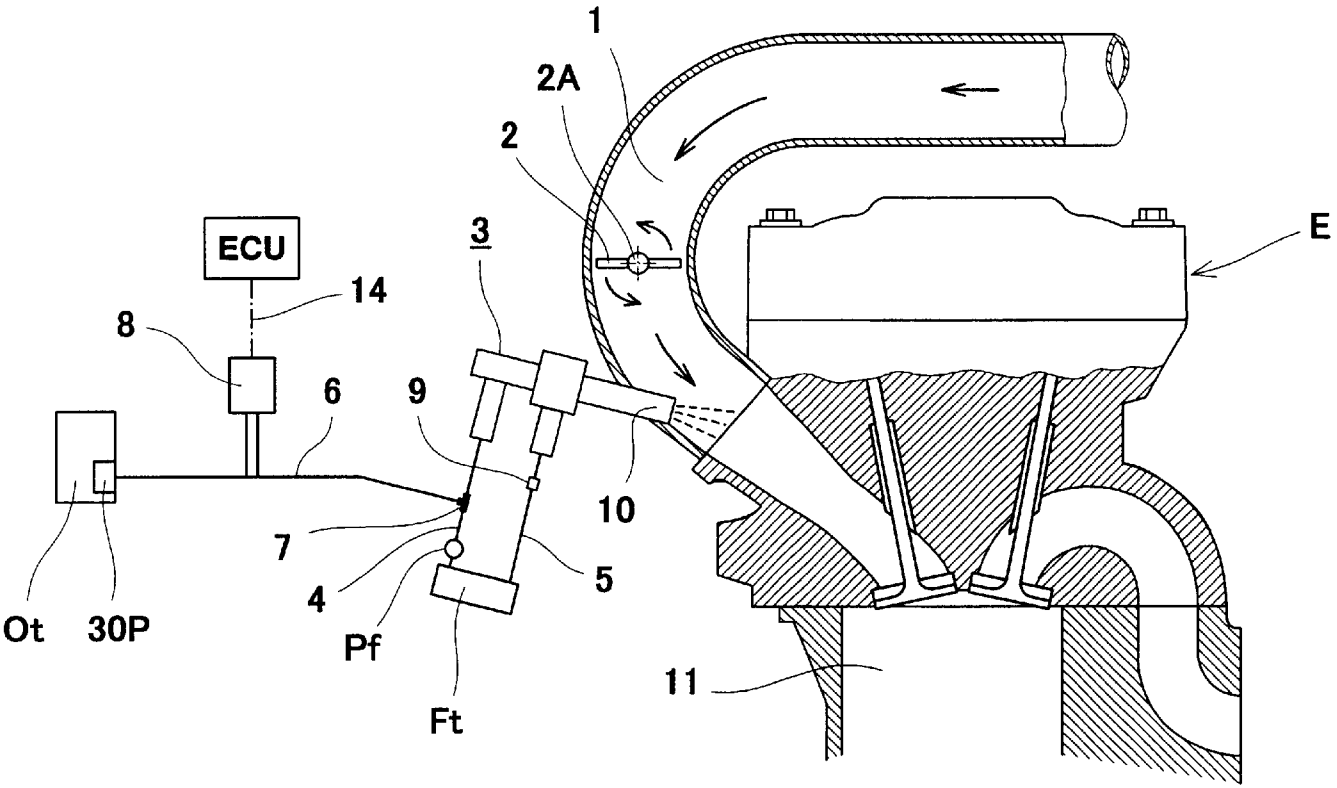
FIG. 4 is a partially enlarged cross-sectional view of an embodiment different from that of FIG. 3, showing an air-intake passage, a cylinder head portion, and a fuel injector, and a fuel supply system schematically shown, which is connected to the fuel injector.
Figure 5:
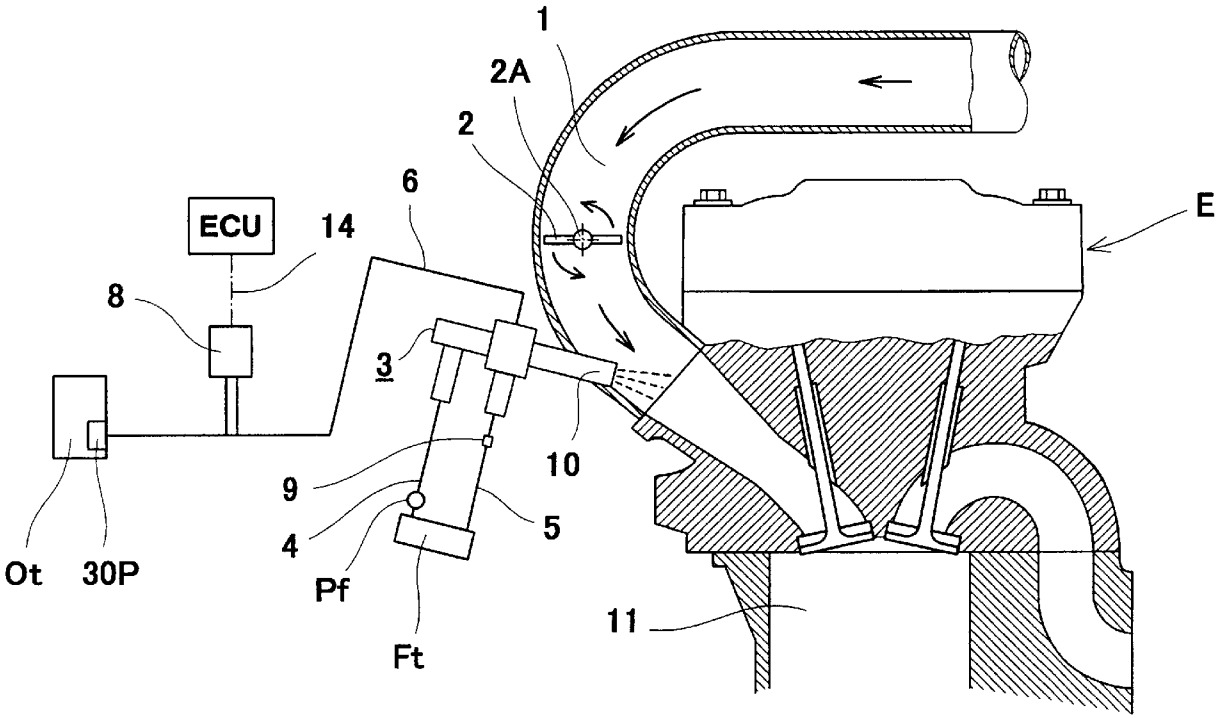
FIG. 5 is a partially enlarged cross-sectional view showing an oil supply system and a fuel supply system according to an embodiment different from that of FIG. 4.

As an alternative to the embodiment of FIGS. 1, 2, the pressure regulator 9 may be provided in the fuel returning passage 5 as shown in FIGS. 4, 5. With this constitution, the function and effects of the present invention can be obtained.

Figure 6:
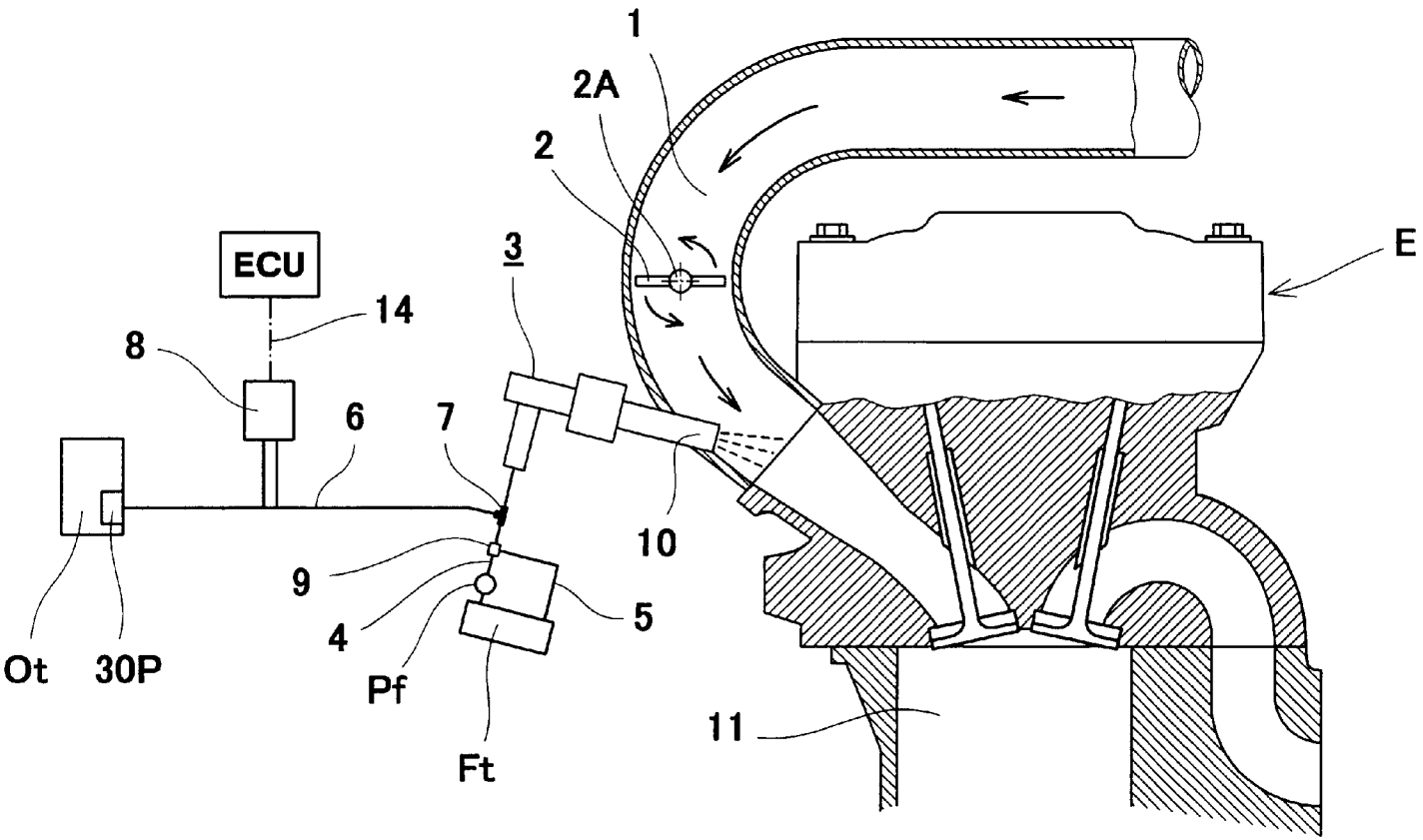
FIG. 6 is a partially enlarged cross-sectional view of an embodiment different from that of FIG. 5, showing an air-intake passage, a cylinder head portion, and a fuel injector, and a fuel supply system schematically shown, which is connected to the fuel injector.

Further, as shown in FIG. 6, the pressure regulator 9 may be provided in the fuel supply passage 4 so as to be located closer to the fuel tank Ft than the T-shaped pipe 7. The pressure regulator 9 may be connected to the fuel returning passage 5 for allowing the fuel to be returned to the fuel tank Ft. This is desirable because no oil is mixed in the fuel to be returned to the fuel tank Ft. As a matter of course, the function and effects of the present invention can be obtained.

Figure 7:
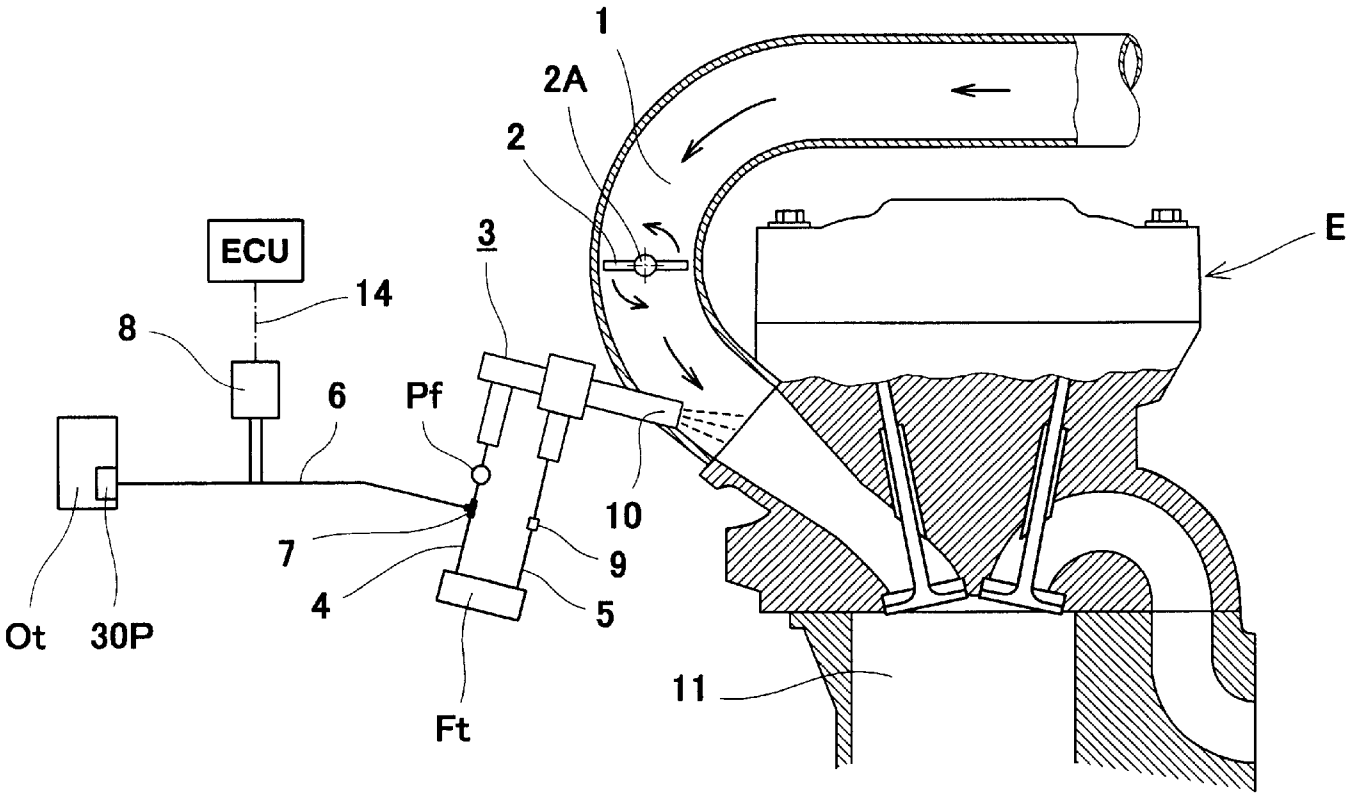
FIG. 7 is a partially enlarged cross-sectional view showing an oil supply system and a fuel supply system according to an embodiment different from that of FIG. 6.

Moreover, as shown in FIG. 7, the fuel pump Pf may be provided in the fuel supply passage 4 so as to be located closer to the fuel injector 3 than the T-shaped pipe 7, and the pressure regulator 9 may be provided in the fuel returning passage 5 connecting the fuel injector 3 and the fuel tank Ft. Also in that case, the function and effects of the present invention can be obtained. In FIGS. 4 through 7, the same reference as those in FIGS. 1, 2 denote the same or corresponding parts.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A four-cycle engine for a small watercraft comprising:

a fuel injector for injecting a fuel into an air-intake passage through an injection nozzle;

an openable valve provided in the air-intake passage for regulating an intake amount of air into a cylinder;

a fuel supply passage through which the fuel is supplied to the injector;

a forced oil supply means for forcibly supplying oil to the fuel supply passage; and an oil supply passage connected to the fuel supply passage by forced oil supply means, wherein the forced oil supply means includes an electromagnetic valve and an oil pump, and the electromagnetic valve is operated according to an engine speed, thereby changing the an amount of oil supply according to the engine speed while the engine is running.

2. The four-cycle engine for a small watercraft according to claim 1, wherein an open time of the electromagnetic valve is increased according to an increase in the engine speed.

3. The four-cycle engine for a small watercraft according to claim 1, wherein an opening of the electromagnetic valve is increased according to an increase in the engine speed.

4. The four-cycle engine for a small watercraft according to claim 1, wherein the oil is supplied in an oil-to-fuel volume ratio in a range of approximately 3:1000 to approximately 20:1000.

5. A four-cycle engine for a small watercraft, comprising:

a fuel injector for injecting a fuel into an air-intake passage through an injection nozzle;

an openable valve provided in the air-intake passage for regulating an intake amount of air provided to a cylinder;

a fuel supply passage configured to fluidically connect a fuel tank to the fuel injector;

a fuel return passage configured to fluidically connect the fuel injector to the fuel tank;

a fuel pump provided in the fuel supply passage for supplying the fuel to the fuel injector at a predetermined pressure;

an oil supply passage configured to supply oil to the fuel being injected from the fuel injector;

a forced oil supply means provided in the oil supply passage; and a fuel regulator for keeping the fuel being supplied to the fuel injector at the predetermined pressure, wherein the forced oil supply means includes an electromagnetic valve and an oil pump, and the electromagnetic valve is operated according to an engine speed, thereby changing an amount of oil supply according to the engine speed while the engine is running.

6. The four-cycle engine for a small watercraft according to claim 5, wherein a tip end of the oil supply passage is connected to the fuel injector, and the fuel regulator is provided in the fuel supply passage.

7. The four-cycle engine for a small watercraft according to claim 5, wherein a tip end of the oil supply passage is connected to the fuel supply passage, and the fuel regulator is provided between a connecting portion where the oil supply passage is connected to the fuel supply passage and the fuel injector.

8. The four-cycle engine for a small watercraft according to claim 5, wherein a tip end of the oil supply passage is connected to the fuel supply passage, and the fuel regulator is provided in the fuel return passage.

9. The four-cycle engine for a small watercraft according to claim 5, wherein a tip end of the oil supply passage is connected to the fuel injector, and the fuel regulator is provided in the fuel return passage.

* * * * *